United States Patent [19]

Harada

[11] Patent Number: 5,049,946

[45] Date of Patent: Sep. 17, 1991

[54] BASE FOR SUPPORTING AN IMAGE FORMING APPARATUS, AND FUNCTION-ADDING DEVICE FOR COMBINATION THEREWITH

[75] Inventor: Kentaro Harada, Tokyo, Japan

[73] Assignee: Kabushiki Kaisha Toshiba, Kawasaki, Japan

[21] Appl. No.: 422,553

[22] Filed: Oct. 17, 1989

[30] Foreign Application Priority Data

Oct. 17, 1988 [JP] Japan ..... 63-261213
Oct. 17, 1988 [JP] Japan ..... 63-261214

[51] Int. Cl.[5] ..... G03G 21/00

[52] U.S. Cl. ..... 355/309; 355/24; 355/200; 355/319

[58] Field of Search ..... 355/309, 319, 320, 23, 355/24, 308, 210, 200, 313, 202

[56] References Cited

U.S. PATENT DOCUMENTS

| | | | |
|---|---|---|---|
| 3,753,560 | 8/1973 | Kapral et al. | 271/9 |
| 4,587,532 | 5/1986 | Asano | 346/134 |
| 4,605,215 | 8/1986 | Hyltoft | 355/200 X |
| 4,639,125 | 1/1987 | Okuda et al. | 355/23 |
| 4,659,207 | 4/1987 | Maekawa | 355/319 X |
| 4,692,022 | 9/1987 | Iwai | 355/24 |
| 4,803,522 | 2/1989 | Sasaki | 355/23 X |
| 4,855,787 | 8/1989 | Hashimoto | 355/24 X |

FOREIGN PATENT DOCUMENTS

| | | | |
|---|---|---|---|
| 0202470 | 11/1984 | Japan | 355/309 |
| 0202452 | 10/1985 | Japan | 355/319 |
| 0172162 | 8/1986 | Japan | 355/319 |

*Primary Examiner*—A. T. Grimley
*Assistant Examiner*—Thu Dang
*Attorney, Agent, or Firm*—Foley & Lardner

[57] ABSTRACT

A base for supporting an image forming apparatus at a predetermined level is constructed by a plurality of units which have the same height and can be removably piled up on each other. At least one of the units may have a drawer and may house a function-adding device which adds a new function to the apparatus when the apparatus is supported on the unit. The device may be a paper reversing machine or an additional paper sheet feeding machine. Each device housed in the unit has a conveying mechanism and a supplying mechanism. The supplying mechanism is connected to an introduction mechanism of the image forming apparatus when the apparatus is mounted on the device, and supplies a paper sheet to the introduction mechanism of the apparatus. Each device further has an introduction mechanism, which is connected to the supplying mechanism of another function-adding unit when the function-adding unit is supported on another such unit.

8 Claims, 5 Drawing Sheets

BASE FOR SUPPORTING AN IMAGE FORMING APPARATUS, AND FUNCTION-ADDING DEVICE FOR COMBINATION THEREWITH

BACKGROUND OF THE INVENTION

1. Field of the Invention

The present invention relates to a base for supporting an image forming apparatus, such as an electro- photographic apparatus, and also to a device which can be combined with the base and the image forming apparatus to add a new function to the image forming apparatus.

2. Description of the Related Art

Generally, a copying machine, as an example of an electrophotographic apparatus, is mounted on a custom designed base of a height that the operation panel of the machine is located about 900 mm above the floor, so that it is easy for a standing operator to operate the machine. The reason why a custom designed base is used is that copying machines of different types have different heights. The base is used not only to support the machine but also to store sheets of copying paper, toner containers, a cleaning kit, and the like.

A base having a specific height must be used to support a coping machine having a specific height, so that the operator can easily operate the machine. In other words, if a copying machine is mounted on the base designed for another copying machine having a different height, it is difficult for the operator to operate the machine. Hence, the manufacturer must manufacture many types of bases having different heights for supporting the various types of copying machines having different heights. The user also has the following problems. When a copying machine is replaced by a new one having a different height, the base also must be replaced with a new one. If the base is discarded, this wastes material. If the base is not discarded and left on the floor for possible future use, the floor area is wasted. Thus, the need for many kinds of bases raises the manufacturing cost and inventory control costs of a manufacturer, and also raises the cost for exchanging bases at the side of the user.

Recently, a copying machine has been developed to which various kinds of function-adding devices can be detachably attached. These devices add new functions to the image forming apparatus when they are attached to the apparatus. Among these devices, for example, a paper-reversing device and a mass storage paper feeding device are well known. The former is used for reversing a paper sheet so that images can be copied on both surfaces, and the latter is used for storing a great number of paper sheets which are of special size or a heavily consumed size and feeding them, one by one, to the copying machine.

A variety of function-adding devices are available. However, two or more function-adding devices cannot be simultaneously used in combination with a copying machine.

Therefore, the manufacturer manufactures many kinds of single-function-adding type machines, and further manufactures many kinds of multi-function-adding type machines, each of which can add two or more functions to the copying machine when its is connected to the bottom surface of the copying machine.

A large number of various kinds of function-adding devices, including single-function-adding type and multi-function-adding type, also raises the manufacturing cost and inventory control cost at the side of the manufacturer, and also raises a cost for exchanging one kind of base for another kind of base at the side of the user.

SUMMARY OF THE INVENTION

Accordingly, the first object of the invention is to provide a base which can support any one of various types of image forming apparatuses and also any of the apparatuses combined with any one of the function-adding devices, at such a level that an operator can easily operate thee image forming apparatus. Such a base can lower both manufacturing and inventory control costs at the side of a manufacturer and also lower the cost for exchanging one base for another one at the side of a user.

The second object of the invention is to provide a function-adding device which can lower the manufacturing cost and inventory control cost at the side of the manufacturer and also lower the cost for exchanging one kind of function-adding device for another kind.

To attain the first object of the invention, a base for supporting an image forming apparatus comprises at least one unit, designed so that a plurality of them have the same height and can be removably piled up on each other.

These plural units form a base having a desired height by changing the number of units piled up. These units can be of the same structure, so that the manufacturer reduces the manufacturing cost and inventory control cost. If the user needs to raise the height of the base, it is merely necessary to purchase the newly required number of units to make a base of the required height. Since the manufacturing cost and inventory control cost for units of the same construction are very much cheaper than in the case of conventional bases for supporting an image forming apparatus, the cost for newly purchasing a desired number of units is considerably cheaper than the cost for newly purchasing another type of base having a different height. In order to lower the height of the base, it is merely necessary to remove the required number of units from the base. The total volume of the removed units is smaller than the volume of conventional bases having various heights, so that the floor area for storing the removed units is smaller than that for storing the conventional bases of various types. By constructing each unit to be easily combined with and separated from each other, the floor area needed for storing the removed units is minimized.

To attain the second object of the invention, various function-adding devices according to this invention are constructed as a plurality of units which can be removably piled up on each other. Each of these units comprises medium-conveying means, medium-feeding means, and medium-introduction means. The medium is used as being formed with an image base in the image forming apparatus. The medium-feeding means of each unit is mounted to face a medium-introduction means on the bottom surface of the image forming apparatus as long as the image forming apparatus is supported on the unit, whereby the feeding of the medium from the medium-conveying means to the medium-introduction means of the upwardly supported apparatus is allowed. The medium-introduction means of each unit faces the medium-feeding means of the downwardly located unit as long as each unit is supported on the other unit, whereby the medium conveyed to the medium-feeding means by the medium-conveying means in the latter unit is introduced into the medium-conveying means in the former unit. A plurality of function-adding devices of the various types, constructed as described above, can be detachably combined with the bottom surface of the image forming apparatus by being piled up on each other, so as to add various functions to the image forming apparatus.

The function-adding device which is formed as a unit performing only one of various functions but which can be combined with other devices, reduces the number of types of the function-adding devices that must be produced by a manufacturer in comparison with conventional devices. The conventional function-adding devices cannot be combined with each other, and many types of the function-adding devices are manufactured. With the invention, users can increase the number of functions which can be added to the image forming apparatus. Therefore, manufacturing cost and inventory control cost at the side of the manufacturer, and the with another kind by the user are low.

DETAILED DESCRIPTION OF THE PREFERRED EMBODIMENTS

Figure 1:
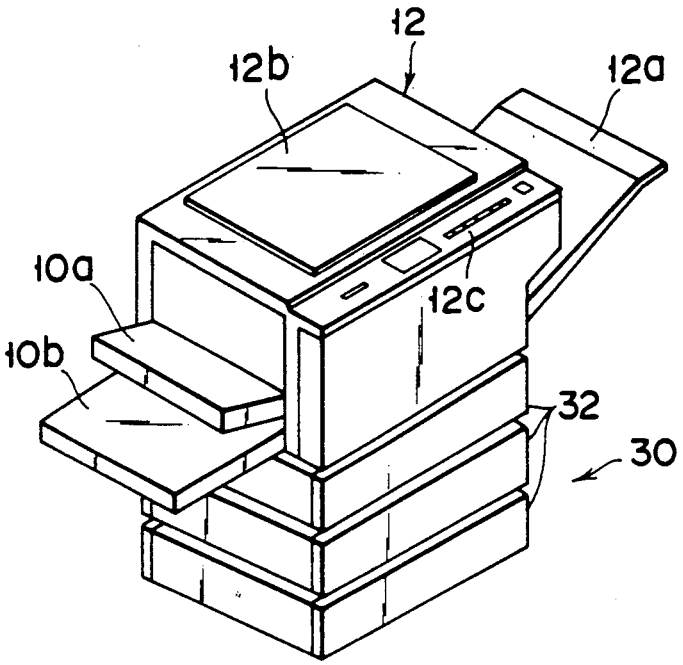
FIG. 1 is a perspective view schematically showing a first base according to a first modification of a first embodiment of the invention and a copying machine supported on this first base.

FIG. 1 shows a first base 30 according to a first modification of a first embodiment of the invention, and also a copying machine 12 mounted on the first base 30. As is shown in this figure, two paper cassettes 10*a* and 10*b* can be detachably connected to one side surface of the housing of the machine 12. On one side surface of the housing, one cassette 10*a* is located above the other cassette 10*b*. The two cassettes 10*a*, 10*b* contain two kinds of copying paper sheets in different sizes. The machine 12 is designed such that a function-adding device can be coupled to the bottom surface. The first base 30 consists of three units 32 of the same structure and the same size, and these units 32 are detachably piled up on each other. Each unit 32 has a height of about 200 mm. Therefore, the first base 30 is about 600 mm tall.

Figure 2:
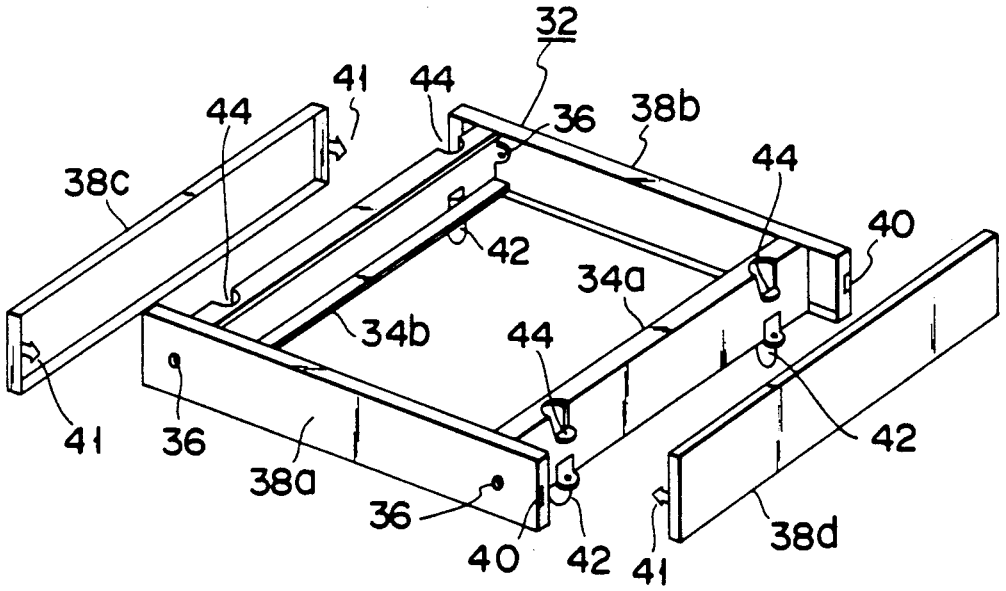
FIG. 2 is a partially exploded perspective view schematically showing one of the identical three units forming the first base shown in FIG. 1.

FIG. 2 schematically shows one unit 32, some parts of which are removed. The unit 32 comprises a pair of main frames 34*a* and 34*b* having the same length and extending parallel to each other, a front cover 38*a* fastened to the front ends of the main frames 34*a* and 34*b* by means of screws 36, and a rear cover 38*b* fastened to the rear ends of the main frames 34*a* and 34*b* by means of screws 36. Since the main frames 34*a* and 34*b* have the same length and extend parallel to each other, the front and rear covers 38*a* and 38*b* also extend parallel to each other, at substantially right angles to the main frames 34*a* and 34*b*. The front cover 38*a* and the rear cover 38*b* have the same length. Each cover has two holes 40 one in each end portion.

The unit 32 further comprises a left cover 38*c* and a right cover 38*d*. Each of the covers 38*c* and 38*d* has two engaging projections 44 protruding from both ends of the cover at right angles thereto. The engaging projections 44 of the left cover 38*c* are fitted in the holes 40 made in the left ends of the front and rear covers 38*a* and 38*b*, respectively, whereby the left cover 38*c* is fastened to the left ends of the covers 38*a* and 38*b*. Similarly, the engaging projections 44 of the right cover 38*d* are fitted in the holes 40 cut in the right ends of the front and rear covers 38*a* and 38*b*, respectively, whereby the right cover 38*d* is secured to the right ends of the covers 38*a* and 38*b*. The left cover 38*c* and the right cover 38*d* have the same length, and extend parallel to each other and also to the main frames 34*a* and 34*b*, and at substantially right angles to the front and rear covers 38*c* and 38*d*. The front cover 38*a*, the rear cover 38*b*, the left cover 38*c*, and the right cover 38*d*, thus assembled together into a rectangular frame, define the outer peripheral surface of the unit 32.

Figure 3:
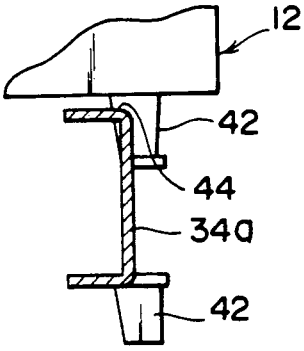
FIG. 3 is a partial sectional view schematically showing a construction for stably supporting the copying machine in FIG. 1 on the uppermost unit in FIG. 1.

The machine 12 has four rubber legs 42 fastened to the bottom, only one of these legs 42 being shown in FIG. 3. The main frames 34*a* and 34*b* of the unit 32 have two recesses 44 each, made in the upper surface. These recesses 44 are used to hold the rubber legs 42 of the machine 12.

The unit 32 also has four rubber legs 42, the first two protruding from the lower surface of one main frame 34*a*, and the other two protruding from the lower surface of the other main frame 34*b*. These rubber legs 42 are vertically aligned with the recesses 44 made in the upper surfaces of the main frames 34*a* and 34*b*. Once the machine 12 is mounted on the unit 32, with its rubber legs 42 inserted in the recesses 44 of the unit 32 as is illustrated in FIG. 3, the machine 12 is stably held on, and vertically aligned with, the unit 32.

The other two units 32, which constitute the base 30 (FIG. 1) jointly with the above described unit 32, are identical in size and structure with the above described unit 32 (FIGS. 2 and 3). Therefore, the three units 32 can be firmly held, one upon another, each with its four rubber legs 42 inserted in the four recesses 44 of the unit on which it is mounted. Additional units 32 of the same size and the same structure can be used in combination with the three units 32, thus forming a base. If this is the case, the more units 32 that are mounted one upon another, the taller the base. More precisely, any number of units 32 are assembled together into a base having a height which is 200 mm multiplied by the number of units 32 used.

Figure 4:
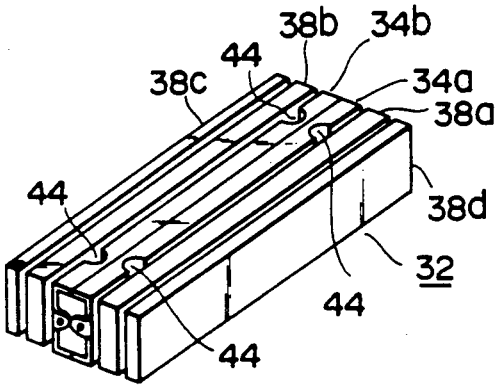
FIG. 4 is a perspective view schematically showing a bundle of the disassembled components of the unit shown in FIG. 2.

As may be understood from FIG. 2, the unit 32 is easy to assemble and disassemble. Hence, unnecessary units 32, if any, can be disassembled. Then, the disassembled main frames 34*a* and 34*b*, front cover 38*a*, rear cover 38*b*, left cover 34*c*, and right cover 34*d* of each can be first arranged, side by side, and then bound together into a smaller unit as is illustrated in FIG. 4. The unnecessary units 32 can thus be disassembled and made compact, but require a small storage space.

Figure 5:
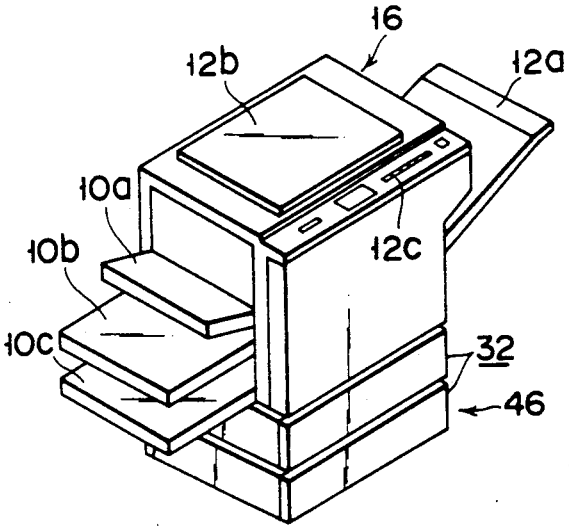
FIG. 5 is a perspective view schematically showing a second base according to a second modification of the first embodiment of the invention, and a copying machine supported base.

FIG. 5 shows a second base 46 according to the first embodiment of the invention, and also a copying machine 16 mounted on the base 46. As is shown in this figure, three paper cassettes 10*a*, 10*b*, and 10*c* are detachably connected to one side surface of the housing of the machine 16. On one side surface of the housing, one cassette 10*a* or 10*b* is located above the other cassette 10*b* or 10*c*. That three cassettes 10*a*, 10*b*, 10*c* contain three kinds of copying paper sheets in different sizes. The machine 16 is also designed such that a function-adding device can be coupled to its bottom. The second base 46 consists of two units 32, each having a height of about 200 mm, as has been described above. The second base 46 is, therefore, about 400 mm tall. Like the copying machine 12 (FIG. 1), the copying machine 16 has four rubber legs 42 protruding from its bottom. These legs 42 are inserted in the recesses 44 of the uppermost unit 32 of the second base 46, whereby the machine 16 is stably mounted on the second base 46.

Figure 6:
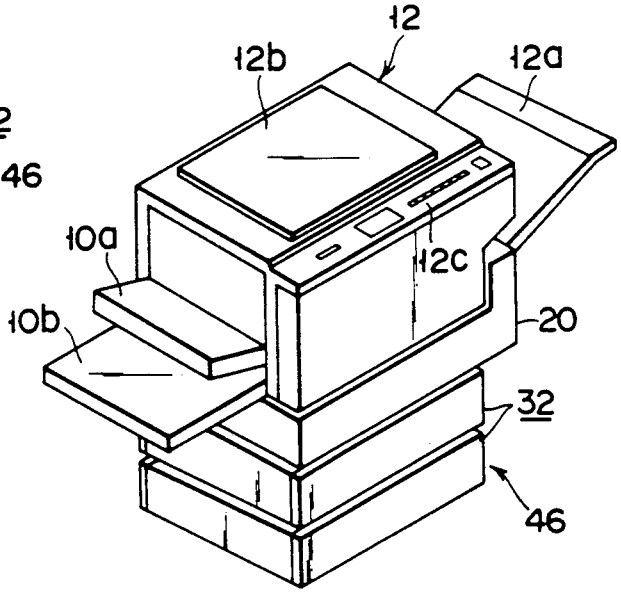
FIG. 6 is a perspective view schematically showing a second base according to the second modification of the first embodiment of the invention, a paper-reversing device supported on this second base, and a copying machine supported on the paper-reversing device.

FIG. 6 shows a base 46 according to a second modification of the first embodiment of the invention, and a copying machine 12 having a paper-reversing device 20 attached to the bottom end thereof. As is shown in FIG. 6, the second base 46 comprises two units 32, each of which has a height of 200 mm. The second base 46 is, therefore, about 400 mm tall. Like the copying machine 12 (FIG. 1), the copying machine 16 shown in FIG. 6 has four rubber legs 42 protruding from its bottom. The paper-reversing device 20 also has four rubber legs 42 protruding from its bottom, and four recesses 44 made in its top surface. The legs 42 of the device 20 are inserted in the recesses 44 of the uppermost unit 32 of the second base 46. Hence, the paper-reversing device 20 can be stably held on the uppermost unit 32. Further, the machine 16 is mounted on the device 20, with its legs 42 fitted in the recesses 44 of the device 20, and is therefore stably held on the paper-reversing device 20.

Figure 7:
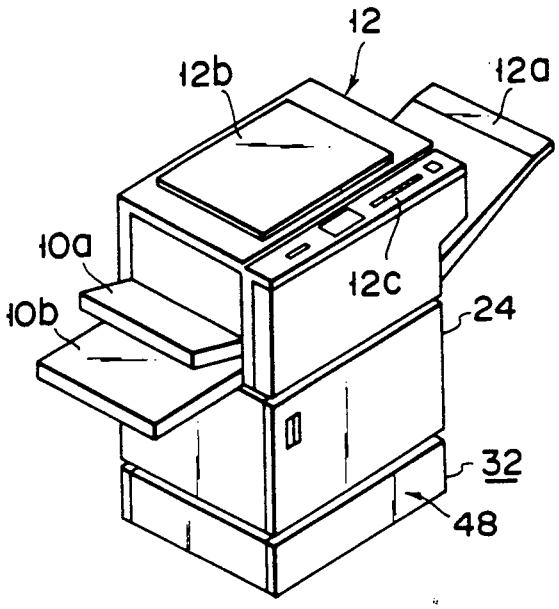
FIG. 7 is a perspective view schematically showing a third base according to a third modification of the first embodiment of the invention, a mass storage paper feeding device supported on this third base, and a copying machine supported on the mass storage paper feeding device.

FIG. 7 shows a third base 48 according to a third modification of the first embodiment of the invention, and a copying machine 12 having a mass storage paper feeding device 24 attached to its bottom end. As is shown in FIG. 7, the third base 48 comprises one unit 32 which has a height of 200 mm. The third base 48 is therefore, 200 mm tall. Like the machine 12 shown in FIG. 1, the machine 12 shown in FIG. 8 has four rubber legs 42 protruding from its bottom. The mass storage paper feeding device 24 also has four rubber legs 42 protruding from its bottom, and four recesses 44 made in its top surface. The legs 42 of the device 24 are inserted in the recesses 44 of the unit 32. Hence, the mass storage paper feeding device 24 can be stably held on the unit 32. Further, the machine 12 is mounted on the device 24, with its legs 42 fitted in the recesses 44 of the device 24, and is therefore stably held on the mass storage paper feeding device 24.

Figure 8:
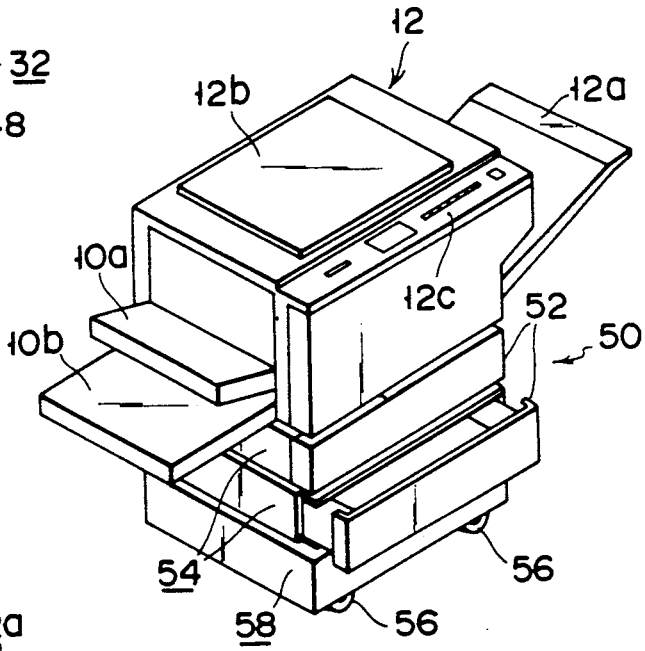
FIG. 8 is a perspective view schematically showing a fourth base according to a second embodiment of the invention, and a copying machine supported on this fourth base.

FIG. 8 illustrates a fourth base 50 which is a second embodiment of the invention, and a copying machine 12 supported on this base 50. Like the machine 12 shown in FIG. 1, the machine 12 in FIG. 8 has four rubber legs 42 protruding from its bottom. The base 50 comprises two units 54 and one caster-equipped unit 58. The units 54 are identical in size and structure to the units 32 which constitute the first, second, and third bases 30, 46 and 48 shown in FIGS. 1, 5, 6, and 8, but are different in that they have drawers 52. The caster-equipped unit 58 has four recesses 44 in the top surface, and four casters 56 secured to the bottom. The rubber legs 42 of the lower unit 54 are fitted in the recesses 44 of the top surface of the caster-equipped unit 58, whereby the lower unit 54 is firmly supported on the caster-equipped unit 58. Similarly, the rubber legs 42 of the upper unit 54 are fitted in the recesses 44 of the lower unit 54, whereby the upper unit is stably mounted on the lower unit 54. Further, the rubber legs 42 of the machine 12 are fitted in the recesses 44 of the upper unit 54, whereby the machine 12 is stably supported on the upper unit 54.

Figure 9:
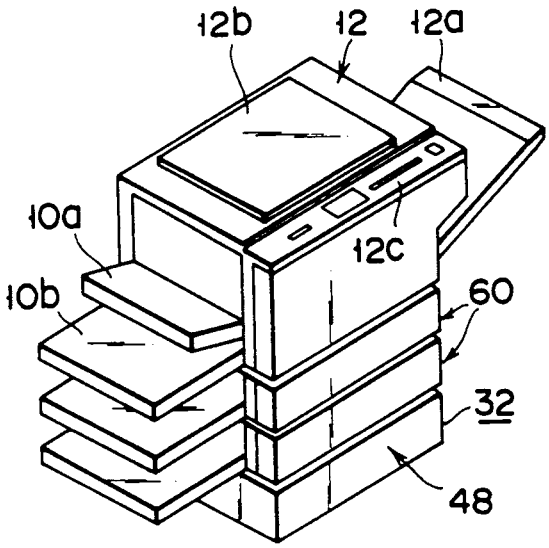
FIG. 9 is a perspective view schematically showing the third base of the same type as that in FIG. 1, two additional paper feeding devices supported on the third base, and a copying machine supported on the two devices.

FIG. 9 illustrates a fourth base 48 which is the fourth modification of the first embodiment of the invention, wherein a first additional paper-feeding device 60 is mounted on the base 48, a second additional paper-feeding device 60 is mounted on the first additional paper-feeding device 60, and a copying machine 12 is mounted on the second additional paper-feeding device 60. The first and second devices 60 are identical in size and structure; each is a first embodiment of a function-adding device according to the present invention.

Figure 10:
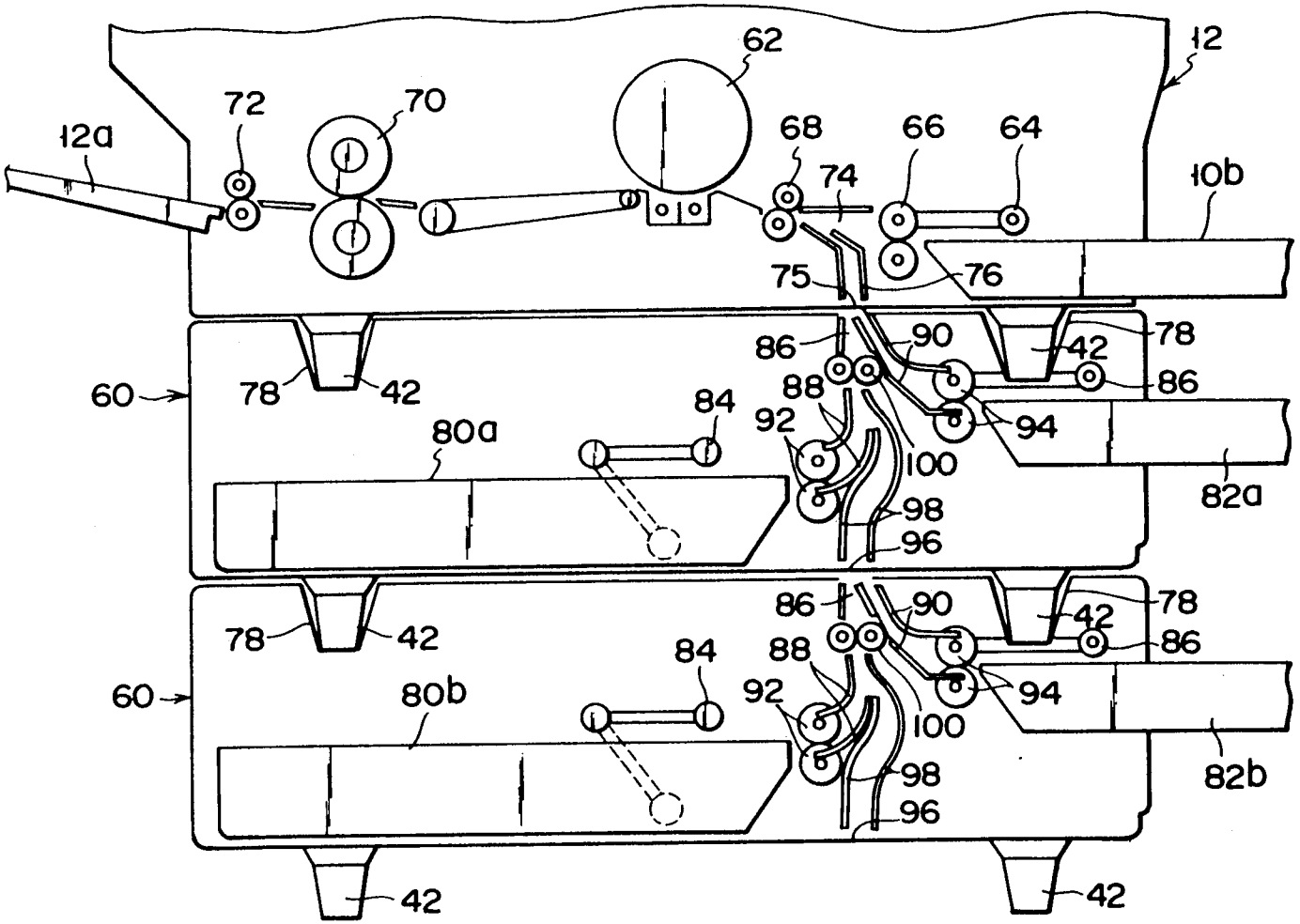
FIG. 10 is a sectional view schematically showing the internal structure of the two additional paper-feeding devices and the copying machine shown in FIG. 9.

FIG. 10 schematically illustrates the main portion of the internal constructions of two additional paper-feeding devices 60 mounted one upon the other, and a copying machine 12 supported on the upper additional paper-feeding device 60.

As is shown in FIG. 10, a photosensitive drum 62 is located within the machine 12, at the center portion thereof. A main paper path 74 extends in the machine 12 from a lower paper-cassette mount for the lower cassette 10*b* to the photosensitive drum 62. A paper pick-up roller 64 is located at the lower paper-cassette mount of the machine 12, so as to feed sheets of paper, one by one, from the lower paper cassette 10*b* held on the paper-cassette mount. Each sheet fed from the lower cassette 10*b* by the roller 64 is supplied by a pair of feed rollers 66 to a pair of resist rollers 68 which are positioned in front of the drum 62. The rollers 68 first forcibly correct any skew movement of the sheet and then feed the sheet to the drum 62. As the sheet passes by the drum 62, an image, which is identical to the image formed on the original held on the original table by the original cover 12*b* (FIG. 1). is transferred from the drum 62 onto the sheet of paper. Then, the sheet is passed between a pair of fixing rollers 70, further between a pair of exit rollers 72, and finally supplied onto the ejected paper tray 12*a*. Though not shown in FIG. 10, a paper pick-up roller and a pair of feed rollers are incorporated in the machine 12, for feeding paper sheets from the upper paper cassette 10*a* to the resist rollers 68.

A connecting paper path 76 is further formed within the machine 12. The path 76 extends from a paper inlet port 75 made in the bottom surface of the machine 12 to the main paper path 74.

Either of the additional paper-feeding devices 60 has a size substantially the same as that of the unit 32 which is best illustrated in FIG. 2. The device 60 has four rubber legs 42 secured to the bottom and four recesses 78 made in the upper surface. The machine 12 is supported on the upper additional paper-feeding device 60, with its rubber legs 42 fitted in the recesses 78 of the upper additional paper-feeding device 60. The upper additional paper-feeding device 60 is, in turn, mounted on the lower additional paper-feeding device 60, with its rubber legs 42 held in the recesses 78 of the lower additional paper-feeding device 60. Further, as is shown in FIG. 10, the lower additional paper-feeding device 60 is mounted on the base 50, with its rubber legs 42 fitted in the recesses 44 of the unit 32 of the base 50.

As is illustrated in FIG. 10, the upper additional paper-feeding device 60 contains a paper tray 80*a*. A paper cassette 82*a* is detachably connected to one side surface of the upper additional paper-feeding device 60. The tray 80*a* can be removed from the device 60, and contains sheets of paper which are different in size or quality from those set in the cassettes 10*a* and 10*b* directly attached to the machine 12. Also, the paper cassette 82*a* contains sheets of paper which are different in size or quality from those contained in the cassettes 10*a* and 10*b* and the tray 80*a*.

The upper additional paper-feeding device 60 further contains two paper pick-up rollers 84 and 86 for feeding paper sheets, one by one, from the tray 80 *a*or the cassette 82*a*. A paper outlet port 86 is cut in the top surface of the device 60. This port 86 is aligned with the paper inlet port 75 made in the bottom surface of the machine 12 when the machine 12 is supported on the device 60 and takes a predetermined position.

Further, a pair of guides 88 and a pair of guides 90 are located within the upper additional paper-feeding device 60. The guides 88 extend from the pick-up roller 84 toward the paper inlet port 75 of the machine 12. The guides 90 extend from the pick-up roller 86 to the paper inlet port 75. A pair of feed rollers 92 are located at the lower ends of the guides 88, for feeding each sheet picked up from the tray 80*a* by the pick-up roller 84, into the paper path defined by the guides 88. Similarly, a pair of feed rollers 94 are located at the lower ends of the guides 90, for feeding each sheet picked up from the cassette 82*a*, into the paper path defined by the guides 90.

The upper additional paper-feeding device 60 has a paper inlet port 96 made in the bottom. The port 96 is aligned with the the paper outlet port 86 of the lower additional paper-feeding device 60 when the upper device 60 is stably supported on the lower device 60. A pair of auxiliary guides 98 extend from the paper inlet port 96 and define another paper path joined to the paper path defined by the guides 88.

The upper additional paper-feeding device 60 has a pair of exit rollers 100 located at the upper ends of guides 88, for feeding each paper sheet from the guides 88 into the machine 12 through the paper outlet port 86 of the device 60 and the paper inlet port 75 of the machine 12.

Each additional paper-feeding device 60 has a drive means (not shown) for driving the two pick-up rollers 84 and 86, the two pairs of feed rollers 92 and 94, and the pair of exit rollers 100. This drive means is connected to the control means (not shown) incorporated in the machine 12 by means of connectors (not shown) located in the top surface of the device 60 and the bottom surface of the machine 12, respectively, and is controlled by the control means.

Each sheet of paper, which has been picked up from the tray 80*a* by the pick-up roller 84, is supplied by the feed rollers 92 into the paper path defined by the guides 88. The sheet is further supplied upwardly by the exit rollers 100 into the machine 12, first through the paper outlet port 86 of the device 60 and then through the paper inlet port 75 of the machine 12, and finally reaches the resist rollers 68 incorporated in the machine 12.

Each sheet of paper, which has been picked up from the paper cassette 82*a* by the pick-up roller 86, is supplied by the feed roller 94 into the paper path defined by the guides 90. The distance between the feed rollers 94 and the paper outlet port 86 is shorter than the distance between the feed rollers 92 and the outlet port 86. Therefore, the sheet is fed into the machine 12 through the outlet port 86 of the device 60 and the inlet port 75 of the machine 12 by means of the feed rollers 94 only. In other words, no exit rollers are required to feed the sheet from the cassette 82*a* to the resist rollers 68 provided within the machine 12.

The lower additional paper-feeding device 60, which supports the upper additional paper-feeding device 60, has the same structure as the upper one. As is shown in FIG. 10, the lower additional paper-feeding device 60 has a paper tray 80*b*, and a paper cassette 82*b* removably connected to one side surface of the lower additional paper-feeding device 60. The tray 80*b* contains sheets of paper which are, in most cases, different in size or quality from those set in the cassettes 10*a* and 10*b* connected to the machine 12 and those contained in the tray 80*a* and cassette 82*a* of the upper additional paper-feeding device 60. Also, the paper cassette 82*b* contains sheets of paper which are, in most cases, different in size or quality from those placed in the cassettes 10*a* and 10*b* connected to the machine 12, those contained in the tray 80*a* and cassette 82*a* of the upper additional paper-feeding device 60, and those set in the paper tray 80*b*.

Each additional paper-feeding device 60 further has a connector (not shown) located at the bottom surface. When one device 60 is stably supported on the other device 60 and the machine 12 is stably supported on the upper device 60, the connector on the bottom surface of the machine 12 is connected to the connector on the top surface of the upper device 60, and the connector on the bottom surface of the upper device 60 is connected to the connector on the top surface of the lower device 60. Therefor, the control means in the machine 12 is connected by the connectors to the drive means incorporated in the upper additional paper-feeding device 60 and further to the drive means in the lower additional paper-feeding device 60.

In the lower additional paper-feeding device 60, each paper sheet, which has been picked up from the tray 80*b* or the cassette 82*b*, is supplied into the paper path defined by the auxiliary guides 98 of the upper device 60, through the paper outlet port 86 of the lower device 60 and the paper inlet port 96 of the upper device 60. Then, in the upper additional paper-feeding device 60, the sheet supplied from the lower device 60 is guided upwardly by the guides 98 and 88, and is further fed upwardly by the exit rollers 100. The sheet is further supplied into the machine 12 through the paper inlet port 75 of the machine 12 and reaches the resist rollers 68 incorporated in the machine 12.

Figure 11:
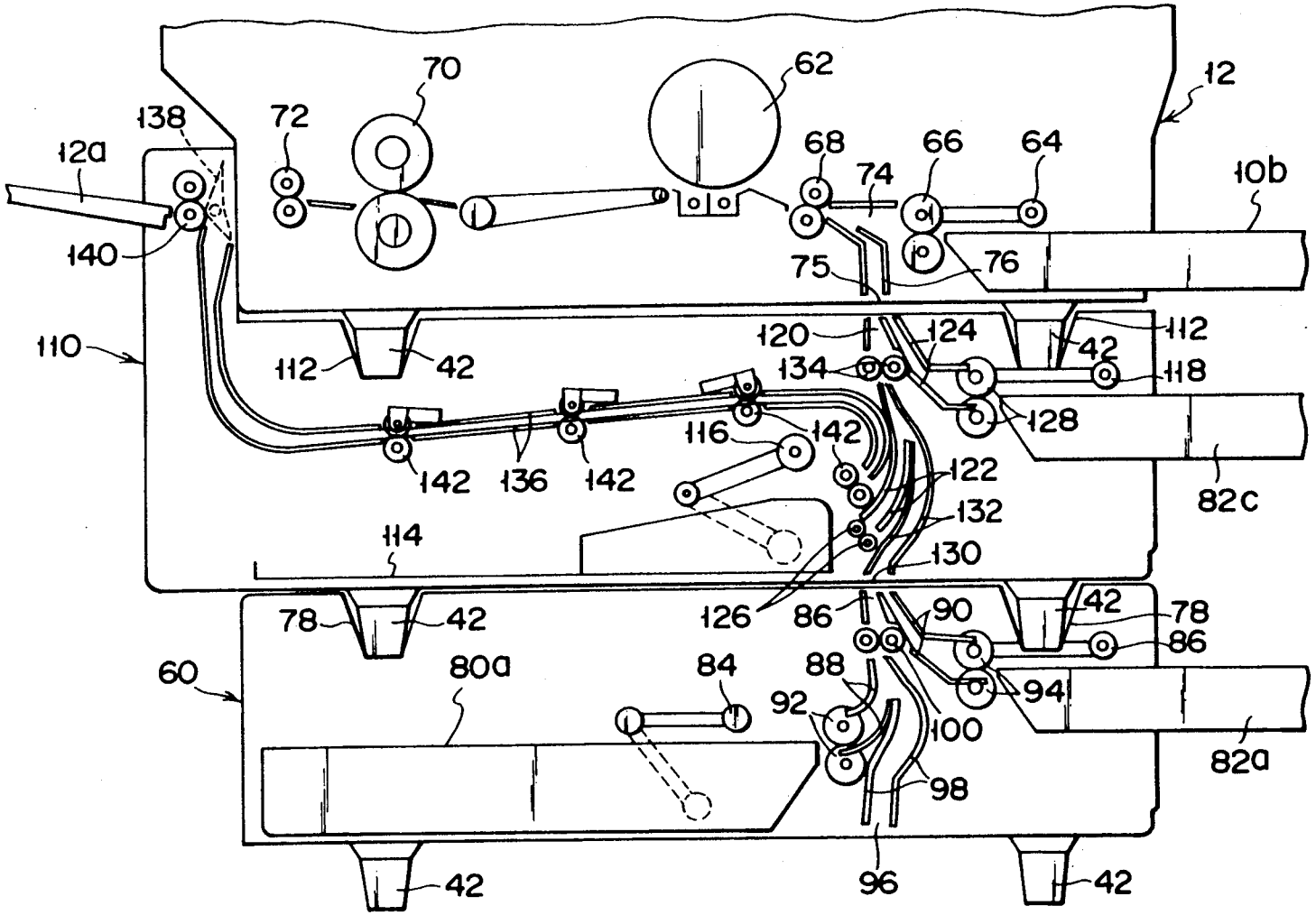
FIG. 11 is a sectional view schematically showing the internal structure of the additional paper-feeding apparatus shown in FIG. 9, and of a paper-reversing apparatus according to a second embodiment of the function-adding device of the invention.

FIG. 11 schematically shows the main portion of the internal constructions of an additional paper-feeding device 60, a paper-reversing device 110 mounted on the device 60, and a copying machine 12 mounted on the paper-reversing device 110. The device 110 is designed to be supplied with a sheet of paper from the paired exit rollers 72 of the machine 12 (after one surface of the paper sheet is provided with an image from the drum 62 in the machine 12), to reverse the direction of the paper sheet, and to return the reversed paper sheet to &he inlet port 75 of the machine 12. The machine 12 can thereby transfer images to both sides of the sheet. The machine 12 and the additional paper-feeding device 60, shown in FIG. 11, are identical in structure with those illustrated in FIG. 10.

The paper-reversing device 110 has the same size as the unit 32 illustrated in FIG. 2. The device 110 has four recesses 112 made in the top surface, and four rubber legs 42 protruding downwardly from the bottom surface. The rubber legs 42 are aligned with the recesses 112 in the vertical direction. The rubber legs 42 of the machine 12 are fitted in the recesses 112 of the device 110, whereby the machine 12 is stably supported on the paper-reversing device 110. The rubber legs 42 of the device 110 are fitted in the recesses 78 of the additional paper-feeding device 60, whereby the device 110 is stably supported on the device 60, as is illustrated in FIG. 9. The four rubber legs 42 of the device 110 can be inserted into the recesses 78 of the unit 32 (FIG. 2), whereby the paper-reversing device 110 can be stably mounted on the unit 32 of the base 48.

As is shown in FIG. 11, the paper-reversing apparatus 110 contains a paper tray 114 for temporarily storing paper sheets which are to be turned upside down. A paper cassette **82*c* is detachably connected to one side surface of the paper-reversing device 110. The cassette 82*c* contains a number of paper sheets which are different in size or quality from those set in the two cassettes 10*a* and 10*b* attached to the machine 12, from those placed in the tray 80*a* incorporated in the additional paper-feeding device 60, and from those contained in the cassette 82*a* attached to the device 60**.

Two paper pick-up rollers 116 and 118 are provided within the device 110. One pick-up roller 116 is used to pick up paper sheets, one by one, from the tray 114, and the other pick-up roller 118 is designed to pick up paper sheets, one by one, from the cassette **82*c*. The paper-reversing device 110 has a paper outlet port 120 in the top surface. This port 120 is aligned with the paper inlet port 84 made in the bottom surface of the machine 12, as long as the machine 12 is mounted on the device 110, with its legs 42 fitted in the recesses 112 of the device 110**.

Further, a pair of guides 122 and another pair of guides 124 are located within the paper-reversing device 110. The guides 112 extend from a position near the pick-up roller 116 toward the paper outlet port 120, and the guides 124 extend from a position near the pick-up roller 118 toward the port 120. A pair of feed rollers 126 are located at the lower ends of the guides 122, for feeding each sheet picked up from the tray 114 by the pick-up roller 116, into the paper path defined by the guides 122. Also, a pair of feed rollers 128 are located at the lower ends of the guides 124, for feeding each sheet picked up from the cassette **82*c* by the pick-up roller 118, into the paper path defined by the guides 124**.

The paper-reversing device 110 has a paper-inlet port 130 cut in the bottom. This port 130 is aligned with the paper-outlet port 86 of the paper-feeding device 60, as long as the device 110 is mounted on the device 60, with its rubber legs 42 inserted in the recesses 78 of the additional paper-feeding device 60. A pair of auxiliary guides 132 are provided within the device 110. These guides 132 extend upwardly from the paper inlet port 130, and connect a paper path defined by the guides 122.

A pair of exit rollers 134 are located at the upper ends of the guides 122, for feeding each sheet from the guides 122 into the machine 12 through the paper outlet port 120 of the device 110 and the paper inlet port 84 of the machine 12.

Further, a pair of horizontally extended guides 136 are provided in the paper-reversing device 110. These guides 136 extend parallel to each other, from a position above the feed rollers 126 located at the lower ends of the guides 122 to the paper outlet port cut in the side surface of the machine 12 to face the exit rollers 72 of the machine 12. The extended guides 136 define a paper path through which paper sheets are supplied from the machine 12 back into the paper tray 114 located within the paper-reversing device 110.

A gate 138 and a pair of additional exit rollers 140 are provided at the upper ends of the guides 136 located on the upwardly projected portion of the device 110, so as to be adjacent to the paper outlet port of the machine 12. As is shown in FIG. 11, the ejected paper tray **12*a*, which has been removed from the paper outlet port of the machine 12, is attached to the upwardly projected portion of the device 110 so as to be adjacent to the additional exit rollers 140, as long as the machine 12 is supported on the paper-reversing device 110. The gate 138 is used to switch the direction in which copied sheets are supplied from the machine 12 through the paper outlet port, either to the addition exit rollers 140 or into the paper path defined by the guides 136**.

Several pairs of feed rollers 142 are located along the paper path defined by the guides 136, for feeding each copied sheet back into the paper tray 114.

The two pick-up rollers 116 and 118, the pairs of feed rollers 126 and 128, the pair of exit rollers 134, the gate 138, the pair of additional exit rollers 140, and the pairs of feed rollers 142 are driven by a drive means (not shown) which is incorporated in the paper-reversing device 110. This drive means is connected to the control means (not shown) incorporated in the machine 12 by means of connectors (not shown) located in the top surface of the device 110 and the bottom surface of the machine 12, respectively, and is controlled by the control means. The device 110 further has a connector (not shown) located in the bottom surface. The connector provided in the bottom surface of the device 110 connects the connector (not shown) provided on the upper surface of the additional paper-feeding device 60, as long as the device 110 is supported on the device 60. Hence, the control means provided in the machine 12 can control the drive means located within the device 20, and also control the drive means incorporated in the device 110.

To copy the image of the original (placed on the original table and covered by the original cover 12*b* in FIG. 1) on one surface of a sheet placed in the cassette 10*a* or 10*b* of the machine 12, or in the cassette 82*c* of the paper-reversing device 110, or in the cassette 82*a* or tray 80*a* of the paper-feeding device 60, the user operates the operation panel 12*c* (FIG. 1) of the machine 12, thus inputting a one-sided-copy command to the control means (not shown) incorporated in the machine 12. In this case, a paper sheet is supplied from the cassette or the tray, which contains paper sheets of the size selected by the user by operating the panel 12*c*, to the resist rollers 68 of the machine 12 by means of the rollers and guides. The image is transferred from the photosensitive drum 62 onto one surface of this sheet of paper. Then, this paper sheet is supplied out of the machine 12 by means of the exit rollers 72, guided by the gate 138, and further supplied onto the ejected paper tray 12*a* by the additional exit rollers 140.

To copy the image of the original (placed on the original table and covered by the cover 12*b* in FIG. 1) on both surfaces of a sheet placed in the cassette 10*a* or 10*b* of the machine 12, or in the cassette 82*c* of the paper-reversing device 110, or in the cassette 82*a* or tray 80*a* of the paper-feeding device 60, the user operates the operation panel 12*c* (FIG. 1) of the machine 12, thus inputting a two-sided-copy command to the control means (not shown) incorporated in the machine 12. A paper sheet is supplied from the cassette or the tray, which contains paper sheets of the size selected by the user by operating the panel 12*c*, to the resist rollers 68 of the machine 12 by means of the rollers and guides. One image is transferred from the photosensitive drum 62 onto one surface of this paper sheet. Then, this sheet is supplied out of the machine 12 by means of the exit rollers 72. The gate 138 guides the sheet into the paper path defined horizontally by the guides 136, not into the ejected paper tray 12*a*. Hence, the paper sheet is supplied into the tray 114 by means of the feed rollers 142. In the tray 114, the sheet is placed upside down; it has been reversed. As soon as the sheet is thus placed in the tray 114, it is picked up by the pick-up roller 116 and fed by the feed rollers 126 into the paper path defined by the guides 122. The paper sheet is supplied upwardly by the exit rollers 134 into the machine 12, first through the paper outlet port 120 of the paper-reversing device 110 and then through the paper inlet port 84 of the machine 12. Hence, the sheet is supplied to the resist rollers 68. This time, the uncopied surface of the sheet contacts the photosensitive drum 62, whereby another image is transferred from the drum 62 onto this remaining surface of the paper sheet. The sheet, now with images copied on both surfaces, is supplied out of the machine 12 by means of the exit rollers 72, guided by the gate 138, and further supplied onto the ejected paper tray 12*a* by the additional exit rollers 140.

What is claimed is:

1. An image forming apparatus comprising:

a first device including means for conveying a copy medium, means for forming an image on the copy medium conveyed by the conveying means, and means, mounted at a predetermined position on a bottom surface of the first device for introducing a copy medium supplied to the predetermined position on the bottom surface toward the conveying means; and a second device detachably located on the bottom surface of the first device, and including a plurality of units which can be detachably stacked in interchangeable order on each other, at least one of the units having means for conveying a copy medium and discharging the copy medium from the at least one unit toward a predetermined position corresponding to the predetermined position on the bottom surface of the first device, means for supplying the copy medium to the conveying means, and means for introducing a copy medium, supplied thereto from the at least one unit, toward the conveying means of the at least one unit.

2. An image forming apparatus according to claim 1, wherein at least one of the units except the at least one unit has at least one drawer.

3. An image forming apparatus according to claim 1, wherein at least one of the units, except the at least one unit, is constructed as a storing case having a door.

4. An image forming apparatus according to claim 1, wherein the at least one unit, located adjacent to the bottom surface of the first device when the second device is located on the bottom surface of the first device, further comprises:

second introducing means, connected to the conveying means of the first device downstream of the image forming means thereof, while the second device is located on the bottom surface of the first device, for selectively introducing a copy medium, conveyed in the conveying means of the first device, into the conveying means of the at least one unit; and means for reversing the copy medium introduced from the first device into the conveying means of the at least one unit by the second introducing means, and for returning the reversed copy medium to the conveying means of the first device upstream of the image forming means thereof.

5. An image forming apparatus comprising:

a first device including means for conveying a copy medium, means for forming an image on the copy medium conveyed by the conveying means, and means, mounted at a predetermined position on a bottom surface of the first device, for introducing a copy medium supplied to the predetermined position on the bottom surface toward the conveying means; and a second device detachably located on the bottom surface of the first device, and including a plurality of units which can be stacked on each other;

at least one of the units having means for conveying a copy medium and discharging the copy medium from the at least one unit, means for supplying the copy medium to the conveying means, and means for introducing a copy medium, supplied thereto from the at least one unit, toward the conveying means of the at least one unit;

wherein a main frame of each of the units is constructed by a plurality of components disjointedly fixed to each other, each of their components having an elongated shape, the lengths and widths of each component being substantially the same, so that the components can be combined with each other with their longitudinal edges and short edges located at both ends of the longitudinal edges, respectively, being trued with each other.

6. The image forming apparatus of claim 5, wherein at least one of the units except for the at least one unit has at least one drawer.

7. The image forming apparatus of claim 5, wherein at least one of the units except for the at least one unit is constructed as a storing case having a door.

8. The image forming apparatus of claim 5, wherein the at least one unit, located adjacent to the bottom surface of the first device when the second device is located on the bottom surface of the first device, further comprises:

second introducing means, connected to the conveying means of the first device downstream of the image forming means thereof, while the second device is located on the bottom surface of the first device, for selectively introducing a copy medium, conveyed in the conveying means of the first device, into the conveying means of the at least one unit; and means for reversing the copy medium introduced from the first device into the conveying means of the at least one unit by the second introducing means, and for returning the reversed copy medium to the conveying means of the first device upstream of the image forming means thereof.

* * * * *